US007152819B2

(12) United States Patent
Ford et al.

(10) Patent No.: US 7,152,819 B2
(45) Date of Patent: Dec. 26, 2006

(54) HIGH PRESSURE MEDIA MILL

(75) Inventors: William Norman Ford, Hockessin, DE (US); Erik H. J. C. Gommeren, Hockessin, DE (US); Qian Qiu Zhao, Hockessin, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 115 days.

(21) Appl. No.: 10/476,312

(22) PCT Filed: May 22, 2002

(86) PCT No.: PCT/US02/16159

§ 371 (c)(1),
(2), (4) Date: Oct. 27, 2003

(87) PCT Pub. No.: WO02/094443

PCT Pub. Date: Nov. 28, 2002

(65) Prior Publication Data

US 2005/0001079 A1 Jan. 6, 2005

(51) Int. Cl.
*B02C 17/16* (2006.01)

(52) U.S. Cl. ..... 241/18; 241/21; 241/23; 241/25

(58) Field of Classification Search ..... 241/21, 241/DIG. 14, 30, 172, 25, 23, 65, 18
See application file for complete search history.

(56) References Cited

U.S. PATENT DOCUMENTS

| | | | | |
|---|---|---|---|---|
| 1,040,455 | A | | 10/1912 | Talum |
| 4,221,342 | A | * | 9/1980 | Tadema et al. ..... 241/79 |
| 5,108,109 | A | | 4/1992 | Leban |
| 5,145,684 | A | | 9/1992 | Liversidge et al. |
| 5,399,597 | A | * | 3/1995 | Mandel et al. ..... 523/342 |
| 5,500,331 | A | | 3/1996 | Czekai et al. |
| 5,662,279 | A | | 9/1997 | Czekai et al. |
| 5,854,311 | A | * | 12/1998 | Richart ..... 523/309 |
| 5,934,579 | A | | 8/1999 | Hiersche et al. |

* cited by examiner

*Primary Examiner*—Mark Rosenbaum

(57) ABSTRACT

This invention discloses a high pressure media mill (HPMM) and processes for use thereof.

11 Claims, 7 Drawing Sheets

1.00 μm 1.00 μm

300 μm 3.00 μm 100 micron 100 micron

HIGH PRESSURE MEDIA MILL

FIELD OF THE INVENTION

This invention discloses a high pressure media mill (HPMM) and processes for use thereof.

TECHNICAL BACKGROUND

Slurry media milling is an important unit operation in various industries for the fine and ultra-fine grinding of minerals, paints, inks, pigments, micro-organisms, food and agricultural products and pharmaceuticals. In these mills, the feed particles are reduced in size between a large number of small grinding media which are usually sand, plastic beads, glass, steel or ceramic beads. As a result of the internally agitated, very small, grinding media and the liquid medium (aqueous, non-aqueous or a mixture thereof, finer particles of submicron or nanosize particles dispersion product can be produced, which has not been previously done by conventional mills.

Supercritical fluid (SCF) processing technology has many applications in food, nutraceutical and chemical industries and is now emerging as an alternative technology in the pharmaceutical industry with applications ranging from particle formation, micro-encapsulation, coating, extraction, and purification. Carbon dioxide is the most widely used SCF for pharmaceutical applications even though other hydrocarbon gases such as ethane, propane, butane and ethylene, water, nitrous oxide ammonia and trifluoromethane have been reported for other applications. Three types of SCF processes have been disclosed. They are:

1) rapid expansion of supercritical solutions (RESS) process, 2) antisolvents process, and 3) particles from gas-saturated solution (PGSS) process.

The RESS process is limited for SCF soluble compounds because it involves dissolving the compounds in the SCF and the subsequent formation of particles by rapid expansion through a nozzle. Most drug compounds have very low solubility in SCF especially supercritical $CO_2$.

The antisolvent process uses the SCF as an antisolvent to precipitate particles from predissolved solvent solution with the sample principle of antisolvent crystallization process. The method developed by University of Bradford in U.S. Pat. No. 5,108,109 combines the antisolvent and nozzle expansion to control particle formation. The limitation of the antisolvent process is a soluble solvent has to be used for a given compound.

Weidner (U.S. Pat. No. 6,056,791) discloses a process to dissolve $CO_2$ in liquid or melted drugs or polymers to form a gas-saturated solution followed by depressurization to form particles. Some apparent disadvantages with this process are that the elevated temperature required to melt the compounds could degrade the compound, and that the high viscosity of melts could limit the particle size of product.

U.S. Pat. No. 5,854,311 discloses the use of 10 to 40 μm particles in powder coating applications. The process disclosed was run at no more than 30 psig.

U.S. Pat. No. 5,500,331 discloses the comminution of materials with small particle milling material. U.S. Pat. No. 5,145,684 discloses surface modified drug nanoparticles. The technology disclosed in these patents relates to a milled slurry, but not dry flowable nanoparticles, as a liquid media is used in the process.

Hock S. Tan and Suresh Borsadia, *Particle Formation Using Supercritical Fluids: Pharmaceutical Applications,* Exp.Opin. Ther. Patents (2001)11(5), Asley Publications Ltd. reviews a number of process concepts using supercritical fluid (SCF) processing methods for controlled particle formation. However the article does not describe grinding milling equipment using SCF to generate dry flowable sized micro particles.

The present invention, a high pressure media milling (HPMM) process, combines a slurry media mill with supercritical fluid (SCF) technology or with volatile gases as a milling medium to produce micron and nanosize particles in a dry free flowing powder form without a limitation of solubility and without the requirement of organic solvents or high temperature. The volatile gas may also include those cooled to a liquid state, such as liquid $CO_2$. The process has applications for use with a broad range of materials including heat sensitive bioactive materials and environmental sensitive electronic materials.

SUMMARY OF THE INVENTION

The present invention concerns a process for milling, comprising the steps of: a) adding grinding media and material to be milled to a high pressure media mill; b) evacuating mill to produce a vacuum; c) adding a supercritical fluid or a volatile gas to said mill; d) pressurizing and maintaining the pressure in said mill; and e) operating the mill so that product particles are reduced in size.

The process also comprises the additional step of adding liquid or solid materials to step (a) for coating product particles.

The above process includes an embodiment wherein the median product particle size less than 200 μm in size, preferably less than 100 μm in size, more preferable less that 1 μm. It is preferred that the product contains no residual milling fluid or gas.

The invention also includes a mill, comprising: a) a grinding chamber capable of holding material at pressures of up to 2000 psig; b) a magnetically driven stirrer in said chamber; and c) a magnetic drive.

The invention also includes the above-described mill further comprising: d) one or more ports leading into said grinding chamber for charging and discharging grinding media, materials to be ground and fluids under high pressure.

BRIEF DESCRIPTION OF THE DRAWINGS

FIG. 5(*b*) shows a scanning electron micrograph of product.

FIG. 5(*c*) shows a scanning electron micrograph of product.

FIG. 6(*b*) shows a migrograph of the same material after grinding.

FIG. 7(*c*) shows a SEM picture of ibuprofen on 19*a*.

DETAILS OF THE INVENTION

The slurry media mill described herein is capable of micron and nanoparticle slurry production and can be widely used in the chemical industry for large scale operations. The SCF is used herein as a low viscosity liquid medium for better dispersion and energy transfer during the milling. Dispersed, dry free-flowing powder is obtained as product when SCF is released after the milling process. Also, the process is not limited to the use of SCF. Under Tc (or $T_{crit}$, critical temperature) and Pc (or $P_{crit}$, critical pressure), liquid $CO_2$ or other volatile gases can be used as the grinding medium.

This process offers significant advantages over existing micronization processes, especially for pharmaceutical applications. These advantages include generation of dry micron and nanosize particles which are difficult or impossible to generate by micronization and other existing processes, integrated coating or encapsulation during milling process, dry fine particles for direct inhalation formulation, including dry powder inhalation and metered dose inhalation as well as oral and parenteral formulations, and integrated disruption and extraction of active ingredients from solid particles, cells, plants and the like.

Figure 1:
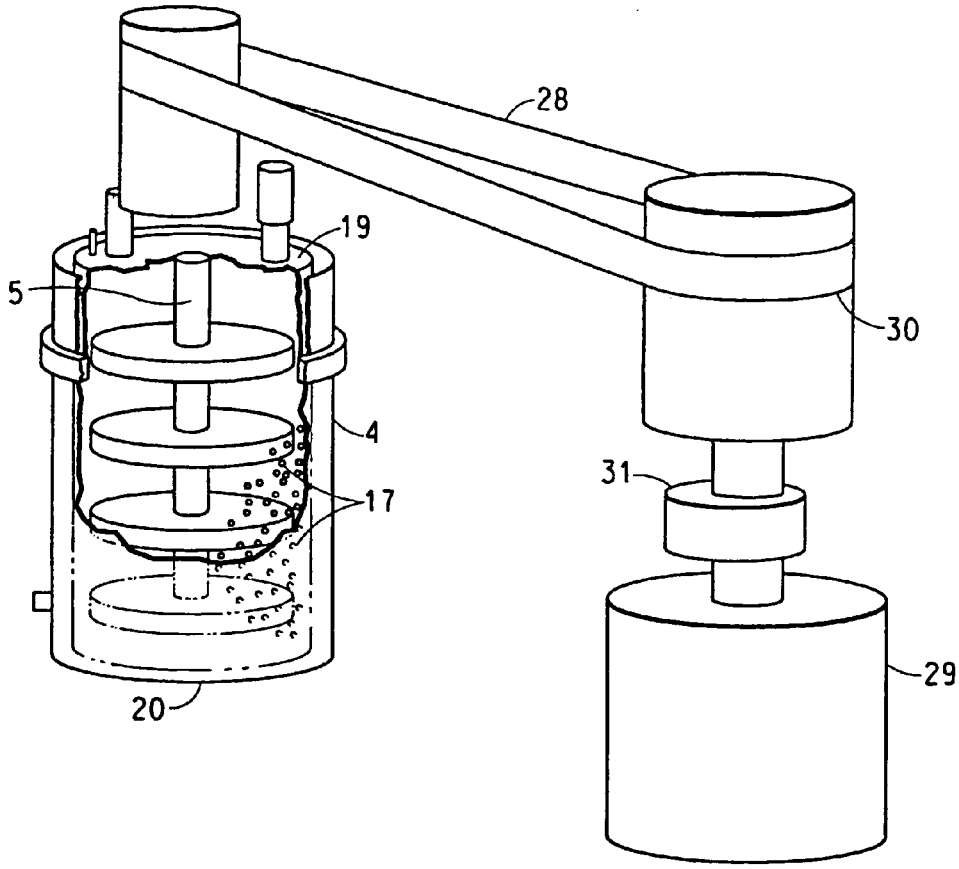
FIG. 1 describes the general design of a SC media mill.

The high pressure media mill (HPMM) arrangement, described herein and shown in FIG. 1, is a media mill grinding chamber (4) which is pressurized with a supercritical gas, e.g. carbon dioxide. The energy required for size reduction, deagglomeration and dispersion of the product particles is derived from a mechanical stirrer (5) that controls a group of stirring discs (17) that move grinding bead media (27) in the mill grinding chamber (4). The mill grinding chamber (4) has a bottom section (20) and a top section (19). Product particles are trapped between stirring discs (17) and are exposed to colliding grinding bead media (27). Drive belt (28) is attached to motor (29) which has speed sensor (30) and torque sensor (31).

The mill is operated above the supercritical pressure and temperature of the fluid, in most cases $CO_2$, although any compressible gas can by used, including but not limited to hydrofluorocarbons (HFC's) and their alternates, propane, methane and the like. Selection of the pressure and temperature allow control of the viscosity and density of the fluid, which has an important effect on the flow patterns, and therefore heat and mass transfer, in the mill chamber.

The HPMM is particularly useful for the production of submicronic particles in dry form. Production of a dry well-dispersed powder is possible because the supercritical fluid is vented off, after processing. There is no need to use water (e.g., some materials, such as proteins, are unstable in water) and the drying step is eliminated. Also, the process train is simplified and integrated (e.g., surface treatment and dispersion of nanocrystalline materials; grinding, disruption of cells and simultaneous extraction of biological components occur without exposure to air/oxygen), and thereby is generally less expensive than other methods of dispersion and grinding.

Figure 2:
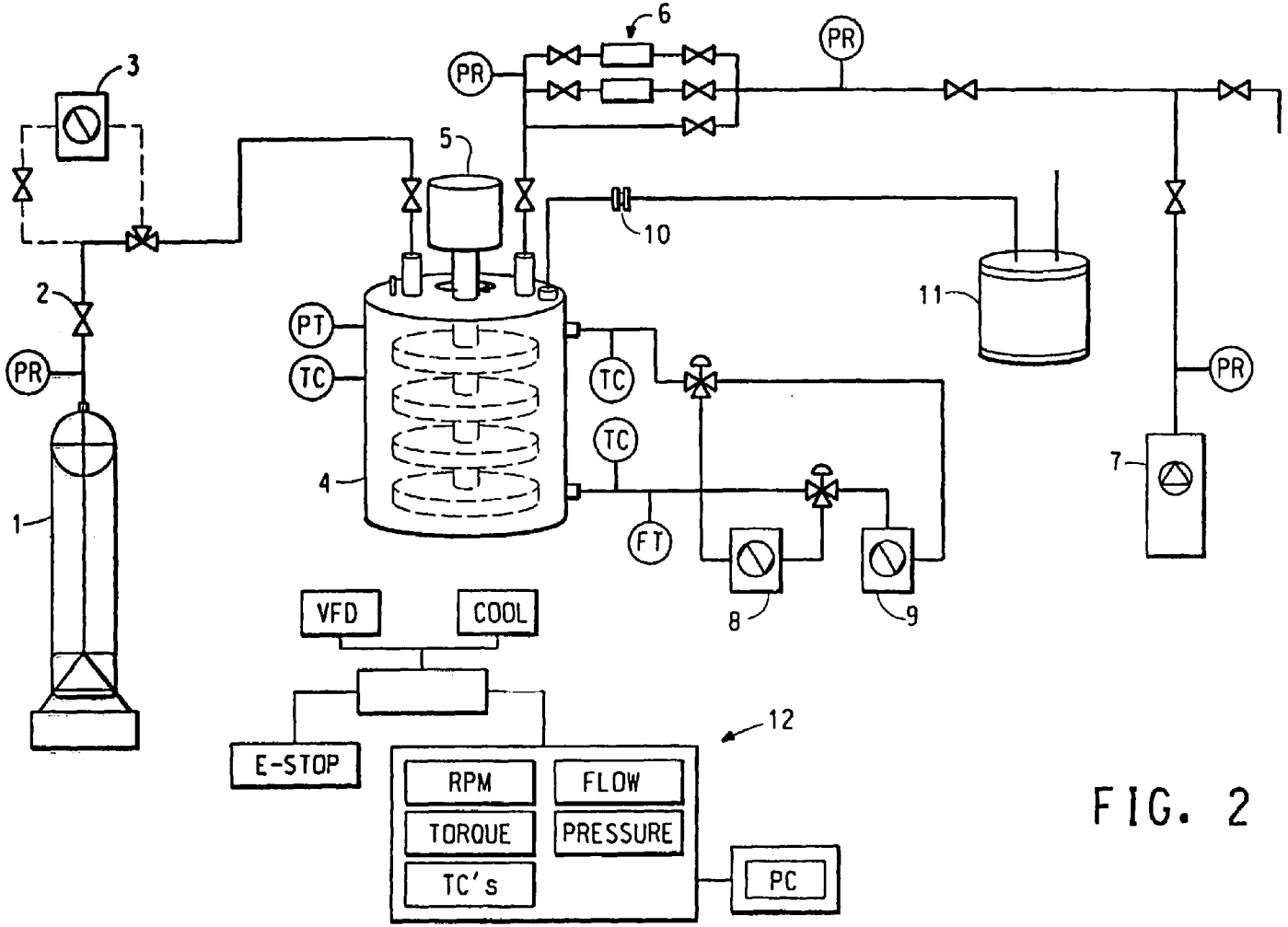
FIG. 2 describes a layout for a media mill pilot plant.

The design of the media mill itself is shown, as described above, in FIG. 1. The grinding chamber is a pressure vessel (4) consisting of a bottom section (20) and a top section (19). The HPMM pilot plant herein, shown as FIG. 2, is assembled by attaching four stirring discs (17) to the shaft controlled by the magnetic stirrer (5) in the top head section (19) of the assembly. The bottom (20) of the vessel is attached to the head section by sealing means. The sealing means can be mechanical, magnetic or a combination thereof. Bolts can be used along with or as part of the sealing means. The connections for cooling and heating (21&22) of the jacket around the vessel are attached.

The lines of the rupture disc (10) to the catch drum (11) and drum vent (25) are attached for safety.

The plug in the charging port (13) in the head section is removed and a funnel is used to charge the grinding media and the solids to be processed. Any other liquid or solid components used to coat the particles are charged through the same port at this time. The port is closed with the plug and ready for charging with the supercritical fluid to be used.

All the valves in the supercritical media mill are closed and the valves (14, 15, and 16) from the vacuum pump (7) through the product collection filters (6) are opened to evacuate the system of all air before processing starts. This vacuum is broken with the SC fluid (1) on scale (24) to be used in the processing and is done by shutting the valves to the vacuum pump (16) and opening the valve to the SC fluid cylinder (2) to be used. This evacuation and purging is repeated three times before charging is started.

When the last pull down of the vessel is complete the weight is recorded from the cylinder scale (24). The cooling water (9) is turned on the jacket and then the vessel is charged with a specific weight of SC fluid and from the cylinder (1) and valve (2) either through the line or by using the pump (3) and then the valve for the cylinder (2) is closed. This weight of fluid is recorded. Valves (14&15) are closed to isolate the vessel.

The motor (5) is turned on to a set speed and the cooling water (8) is turned off and heating (9) is started. The heating is set at the specific temperature for the designed experiment being conducted. The data is recorded on the monitoring and control system (12) including RPM, torque, temperatures, pressure, and flow rate in GPM to the jacket until the desired test time is complete.

The heating (9) is then stopped and the cooling (8) is started and when the vessel temperature is below 25 degrees centigrade the motor drive (5) is stopped. When the cooling is complete the valve (15) is opened to collect the product in the collection filters (6). The material is recovered from the filters for use.

The bottom section (20) of the mill is removed and all the excess material left behind in the vessel and on the blades is recovered and the unit is cleaned and re-assembled for future tests.

START UP CONDITIONS

Initial experiments dealt with loading and unloading of the mill, product collection, temperature and power control and data acquisition.

Figure 4:
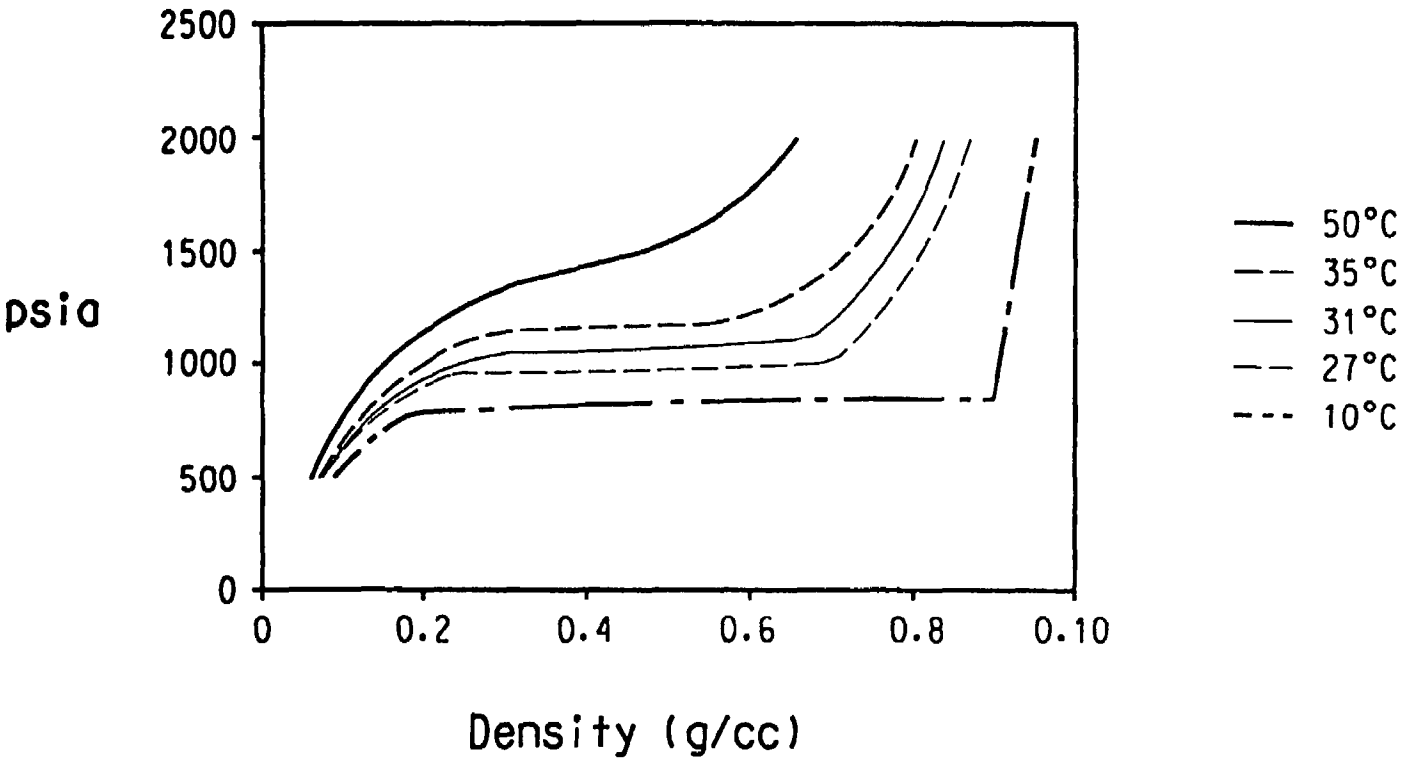
FIG. 4 describes calculated values for pressure density curves.

Before loading with SC $CO_2$ the mill needs to be evacuated of air in a vacuum cycle. The vacuum cycle should be repeated at least 3 times to remove entrapped air. Monitoring of pressure and temperature is essential as small changes can lead to large pressure built-up. Monitoring allows the location in the SC region in the phase diagram (FIG. 4). Furthermore, after initial testing, the following results were noted:

Fast dispersion of $TiO_2$ in the SC mill was noted. The primary particle size was achieved within 10 min. Polymer bead collision was sufficient to break down $TiO_2$ agglomerates. Polymer beads reduced wear rate, compared to SEPR.

The loading of the mill was measured with a scale to a preferred loading of 0.65 to 0.7 g/cc.

The operation conditions followed a phase diagram as shown in FIG. 4. The heat exchange/mixing was relatively poor at lower RPM.

Acceptable results were achieved at 50–70 volume percent bead loading. Good circulation of mill contents was also noted.

Thermodynamics

Figure 3:
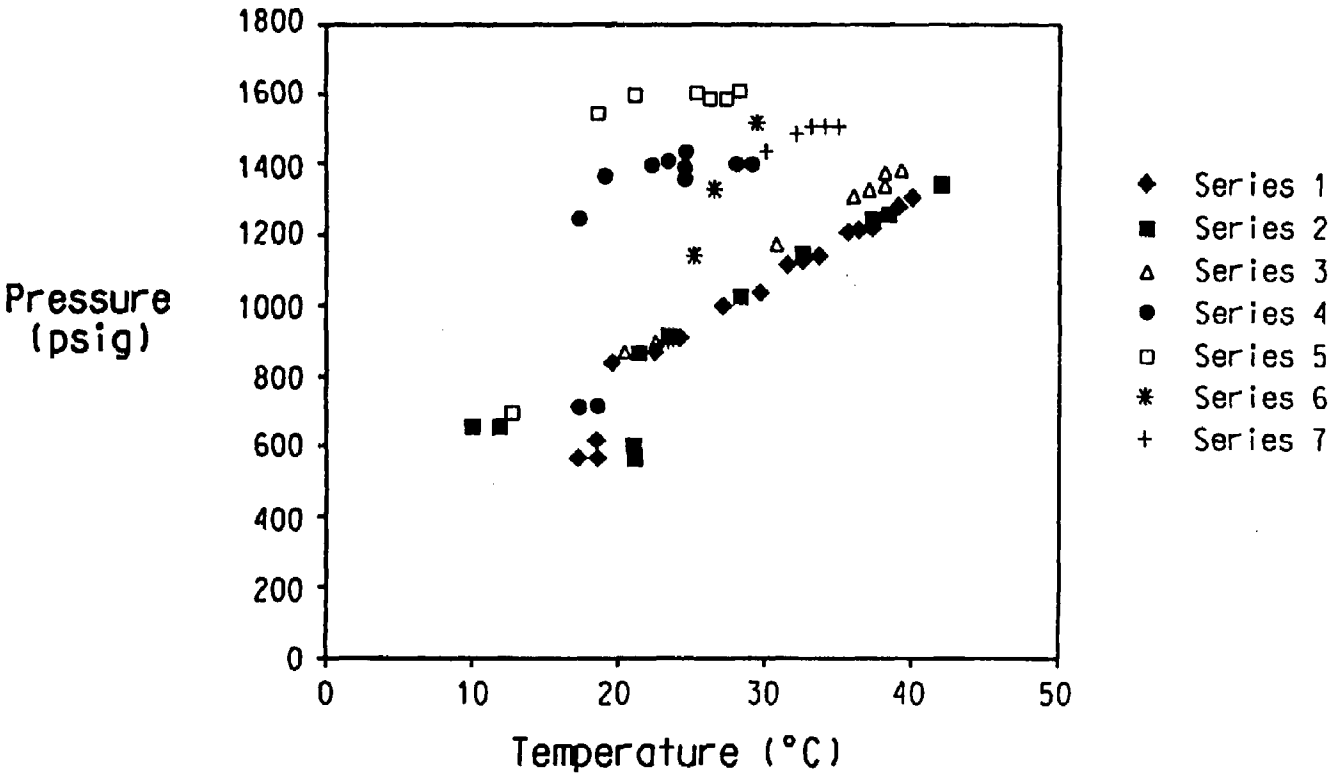
FIG. 3 shows a PT curve for $CO_2$ in a SC media mill.

The PT-curves for the different runs are shown in FIG. 3. The effect of venting is clearly seen. Apparently, if the runs start off with a too high density (more $CO_2$ mass in SC mill, such as series 5,6), the pressure has to increase to 4000 psig to get to the supercritical isotherm (Tcrit=31.1C).

series 1: only heating series 2: heating+stirring series 3: heating+stirring run 2 series 4: heating+stirring+$TiO_2$ 50 g series 5: heating+stirring+$TiO_2$ 150 g series 6: heating+stirring+$TiO_2$ 150 g venting 1 series 7: heating+stirring+$TiO_2$ 150 g venting 2

FIG. 4 is a "Calculated Pressure-Density Curve" and shows the calculated values for different operating temperatures (10, 27, 31, 35, 50° C.). The mill chamber of a constant volume is loaded with a known mass of $CO_2$. Therefore the density of $CO_2$ stays at a constant levels over a test run. The Figure is used to predict the pressure in the SC mill chamber for different operating temperatures and allows confirmation that SC conditions are achieved.

DEFINITIONS

The following definitions are used herein:

SC: Supercritical

SC $CO_2$: MG Industries, Malvern, Pa.

Fungicide: Famoxadone

SEPR: Ceramic grinding media from S. E. Firestone Assoc., Russell Finex Inc., Charlotte, N.C.

YTZ: Ceramic grinding media from S. E. Firestone Assoc., Russell Finex Inc., Charlotte, N.C.

Poly-Sty: Polystyrene Grinding Media from S. E. Firestone Assoc., Russell Finex Inc., Charlotte, N.C.

Nylon: Nylon Powder, DuPont Co., Wilmington, Del.

Silver: silver particle for application in Silver Bearing Conductors, DuPont Company, Wilmington Del.

Unless otherwise specified, all chemicals and reagents were used as received from Aldrich Chemical Co., Milwaukee, Wis.

EXAMPLES

Examples 1–19

The following experiments were carried out with the HPMM to explore the operating range (rotor speed, pressure level, run time) and to study the effects of media charge, media type and additives. The test conditions are listed in Table 1. "Test conditions". The following (organic and inorganic) materials were tested.

O Inorganic—insoluble in $H_2O$ ($TiO_2$)

O Organic—soluble in $H_2O$ (dextrose, acetaminophen, ibuprofen)

O Organic—insoluble in $H_2O$ (famoxadone)

O Inorganic—soluble in $H_2O$ (NaCl)

In addition, silver bearing conductive pastes were tested. These are thick film compositions for application onto ceramic substrates and dielectric compositions by screen printing. These substrates are then fired in a conveyor belt furnace in an oxidizing atmosphere (air) to form interconnect tracks and pads in single- and multillayer microcircuits. Silver bearing conductor pads are normally used for passive SMT components attachment with low-temperature eutectic Sn/Pb solders or with conductive epoxy adhesives.

Acetaminophen (Paracetamol) was tested on the HPMM to produce particles in the 1–5 micron range for inhaler applications.

Example 19a, 19b and 19c

Ibuprofen on HPMM

Table 1 lists the conditions of the experiments with ibuprofen on the HPMM. The ibuprofen was bought from Spectrum Chemicals. The fluid for the runs was $CO_2$.

Run 19*a* Media milling of ibuprofen in supercritical $CO_2$.

During run 19a the temperature was maintained at 35° C. The pressure in the mill chamber was 1550 psi. The total run time was 2 hrs. Product was collected after depressurization using a vibratory screen.

Figure 7A:
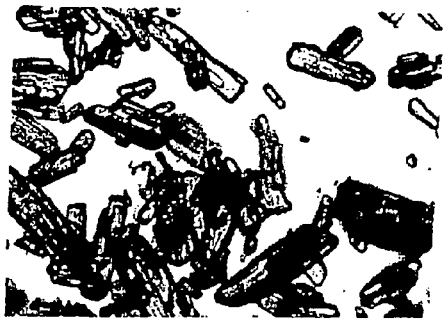
FIGS. 7(*a*) and (*b*) show a light microscope picture of the proceed material in 19*a*.
Figure 7B:
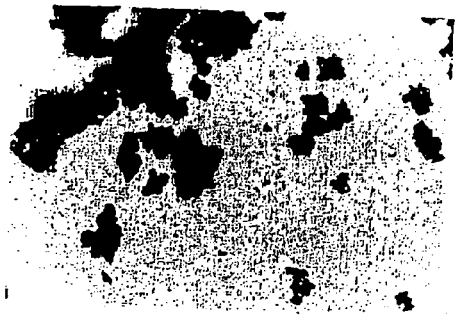
Figure 7C:
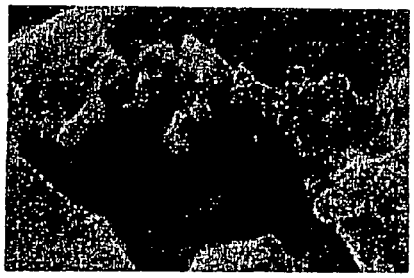

Table 2 lists the produced median particle size (D50). The particle size distribution was measured with a forward light scattering device (Malvem Mastersizer 2000). The size distribution shifted to the right, indicating growth of the particles due to agglomeration and aggregation of fine product particles. Light microscope and SEM pictures confirmed this. FIGS. 7*a* and *b* show a light microscope picture (Nikon Optiphot) of the as received ibuprofen. FIG. 7*c* shows a picture of the processed material (run 190 19a).

FIG. 7*c* shows a SEM picture of the ibuprofen of run 19a with particles as small as 30 nanometer. The operating temperature of run 19a (35° C.) was higher than the softening temperature of ibuprofen, which caused fusion/aggregation of these particles.

Run 19b Media milling of ibuprofen in liquid $CO_2$ and surfactant (SDS)

The objective of this run was to demonstrate that agglomeration can be avoided/reduced by a lower operating temperature and a surfactant. During run 19b the temperature was maintained at 10° C., while the pressure in the mill chamber was 600 psi (see Table 2). The total runtime was 30 minutes. 35 wt % surfactant (Sodium dodecyl Sulfate, MW=288.38, supplied by ICN Biomedical Inc.).

Figure 8:
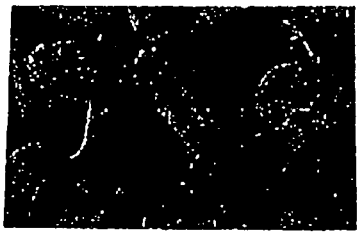
FIG. 8 shows a SEM picture of ibuprofen at a kv accelatioin of run 19(*c*).

The particle size was reduced from 33.85 microns (as received) to 1.805 micron. FIG. 8 shows an SEM picture of the product of run 19b.

Run 19c: Media milling of ibuprofen in liquid $CO_2$ and surfactant (SDS)

As in Run 19b, ibuprofen was milled in liquid $CO_2$, but with 2 wt % SDS surfactant used. The results are shown in Table 2.

TABLE 1

| | Test conditions | | | | | | |
|---|---|---|---|---|---|---|---|
| No. Ex. | Bead Type | Bead % | Bead Size (mm) | Product Grams | Prod. | $CO_2$ Grams | Additive Name/Grams |
| 1 | SEPR | 80 | .8–1.0 | 50 | $TiO_2$ | 410 | |
| 2 | SEPR | 76 | .8–1.0 | 150 | $TiO_2$ | 410 | |
| 3 | SEPR | 80 | .8–1.0 | 150 | $TiO_2$ | 386 | |
| 4 | SEPR | 50 | .8–1.0 | 150 | $TiO_2$ | 477 | |

TABLE 1-continued

| No. Ex. | Bead Type | Bead % | Bead Size (mm) | Product Grams | Prod. | $CO_2$ Grams | Additive Name/Grams |
|---|---|---|---|---|---|---|---|
| | | | | Test conditions | | | |
| 5 | SEPR | 70 | .8–1.0 | 150 | $TiO_2$ | 410 | |
| 6 | Poly-Sty. | 70 | 0.5 | 150 | $TiO_2$ | 363 | |
| 7 | Poly-Sty. | 50 | 0.5 | 150 | $TiO_2$ | 454 | |
| 8 | Poly-Sty. | 70 | 0.5 | 150 | Dextrose | 295 | |
| 9 | Poly-Sty. | 70 | 0.5 | 150 | Dextrose | 318 | |
| 10 | Poly-Sty. | 70 | 0.5 | 150 | NaCl | 340 | |
| 11 | SEPR | 70 | .8–1.0 | 150 | Dextrose | 363 | |
| 12 | SEPR | 70 | .8–1.0 | 150 | NaCl | 363 | |
| 13 | Poly-Sty. | 70 | .25/.15 | 150 | Silver | 431 | |
| 14 | Poly-Sty. | 70 | 0.5 | 150 | Silver | 363 | |
| 15 | SEPR | 70 | .8–1.0 | 150 | Famoxadone | 363 | |
| 16 | Nylon | 70 | .5/.88 | 150 | $TiO_2$ | 409 | |
| 17 | Poly-Sty. | 70 | 0.5 | 150 | Silver | 363 | Stearic acid/ 0.75 |
| 18 | Poly-Sty. | 70 | 0.5 | 150 | Silver | 363 | Stearic acid/ 0.75 |
| 19 | YTZ | 70 | 0.3 | 150 | Acetominophen | 370 | |
| 19a | SEPR | 70 | .8–1.0 | 150 | Ibuprofen | 370 | — |
| 19b | SEPR | 70 | .8–1.0 | 110 | Ibuprofen | 370 | Sodium dodecyl sulfate/36 g |
| 19c | SEPR | 70 | .8–1.0 | 150 | Ibuprofen | 370 | Sodium dodecyl sulfate/3 g |

Process monitoring and Product Characterization:

During each test run, the temperature and pressure in the HPMM, the power intake by the mill, the speed of the stirrer were monitored. The products were characterized by their size, shape, surface morphology and reactivity/activity.

Figure 6A:
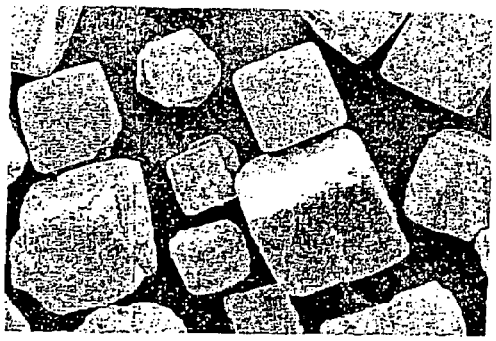
FIG. 6(*a*) shows a micrograph of NaCl starting material.
Figure 6B:
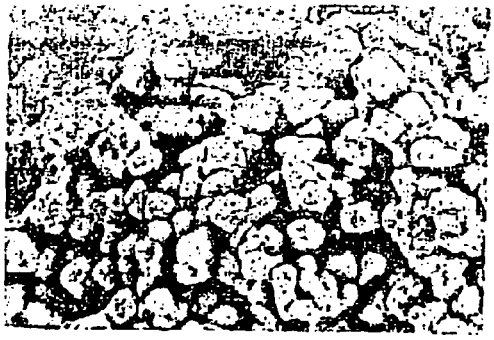

The particle size distribution of the feed and the product were measured with the Microtrek UPA and Microtrek FRA by Leeds and Northrop, (see Table 2). Scanning electron micrographs (SEM) were taken using a Hitachi S-4700 (Hitachi Instruments, San Jose, Calif.) with the powder samples mounted on double sided sticky tape, and x-ray powder diffraction were carried out on a number of samples. The instrument used for powder diffraction studies is a Philips X-ray Diffractometer PW 3040 (Philips Analytical Instruments, Natick, Mass.). The technique used is powder x-ray diffraction using CuKα radiation. FIG. 6*a* shows an SEM of the NaCl of Example 12 before grinding, and FIG. 6*b* shows an SEM of the same material after grinding. The decrease in size of the material can be noted.

TABLE 2

Summary of test results (all milling tests @ 1750 rpm)

| Ex. No. | Total time Hrs. | SC time Hrs. | Net Torque (zero = 14.6) In-lbs. | Watts | Temp. Celsius | Pressure Psi | Energy KWh. | Specific Energy KWh./Kg | Median particle size D50 [micron] |
|---|---|---|---|---|---|---|---|---|---|
| 1 | 2.00 | 1.80 | 22.8 | 472 | 35 | 1400 | 0.94 | 18.89 | 0.34 |
| 2 | 1.60 | 0.50 | 25.4 | 526 | 33 | 1500 | 0.84 | 5.61 | 0.27 |
| 3 | 1.08 | 0.50 | 45.4 | 940 | 38 | 1300 | 1.02 | 6.77 | 0.32 |
| 4 | 0.83 | 0.50 | 10.6 | 220 | 37 | 1350 | 0.18 | 1.21 | 0.28 |
| 5 | 0.25 | 0.17 | 23.4 | 485 | 36 | 1550 | 0.12 | 0.81 | 0.28 |
| 6 | 0.28 | 0.17 | 10.4 | 215 | 34 | 1320 | 0.06 | 0.40 | 0.35 |
| 7 | 0.33 | 0.10 | 2.4 | 50 | 32 | 1330 | 0.02 | 0.11 | 0.37 |
| 8 | 0.25 | 0.17 | 12.4 | 257 | 35 | 1300 | 0.06 | 0.43 | 173 |
| 9 | 0.50 | 0.42 | 17.4 | 360 | 36 | 1400 | 0.18 | 1.20 | 185 |
| 10 | 0.25 | 0.00 | 7.4 | 153 | 25 | 570 | 0.04 | 0.26 | — |
| 11 | 1.00 | 0.83 | 23.4 | 485 | 40 | 1580 | 0.48 | 3.23 | 58 |
| 12 | 1.00 | 0.83 | 20.4 | 422 | 38 | 1530 | 0.42 | 2.82 | 4.3 |
| 13 | 1.00 | 0.75 | 0.9 | 19 | 35 | 1240 | 0.02 | 0.12 | 23 |
| 14 | 1.00 | 0.83 | 2.7 | 56 | 37 | 1300 | 0.06 | 0.37 | 1.8 |
| 15 | 1.00 | 0.66 | 20.4 | 422 | 33 | 1550 | 0.42 | 2.82 | 5.4 |
| 16 | 0.50 | 0.36 | 6.9 | 143 | 37 | 1375 | 0.07 | 0.48 | 0.33 |
| 17 | 1.00 | 0.95 | 6.4 | 133 | 40 | 1400 | 0.13 | 0.88 | 1.78 |
| 18 | 1.00 | 0.83 | 7.8 | 162 | 40 | 1400 | 0.16 | 1.08 | 28.31 |
| 19 | 4.00 | 3.70 | 27.4 | 583 | 46 | 1600 | 0.16 | 2.11 | 5.2 |
| 19a | 2.00 | 2.00 | 5.0 | 104 | 35 | 1550 | 0.21 | 1.38 | 44.68* |
| 19b | 0.50 | 0.50 | 3.2 | 66 | 10 | 600 | 0.03 | 0.30 | 1.805 |
| 19c | 2.00 | 2.00 | 3.1 | 61 | 10 | 600 | 0.13 | 1.11 | 4.106 |

*agglomerates

Examples 20–26

Figure 5A:
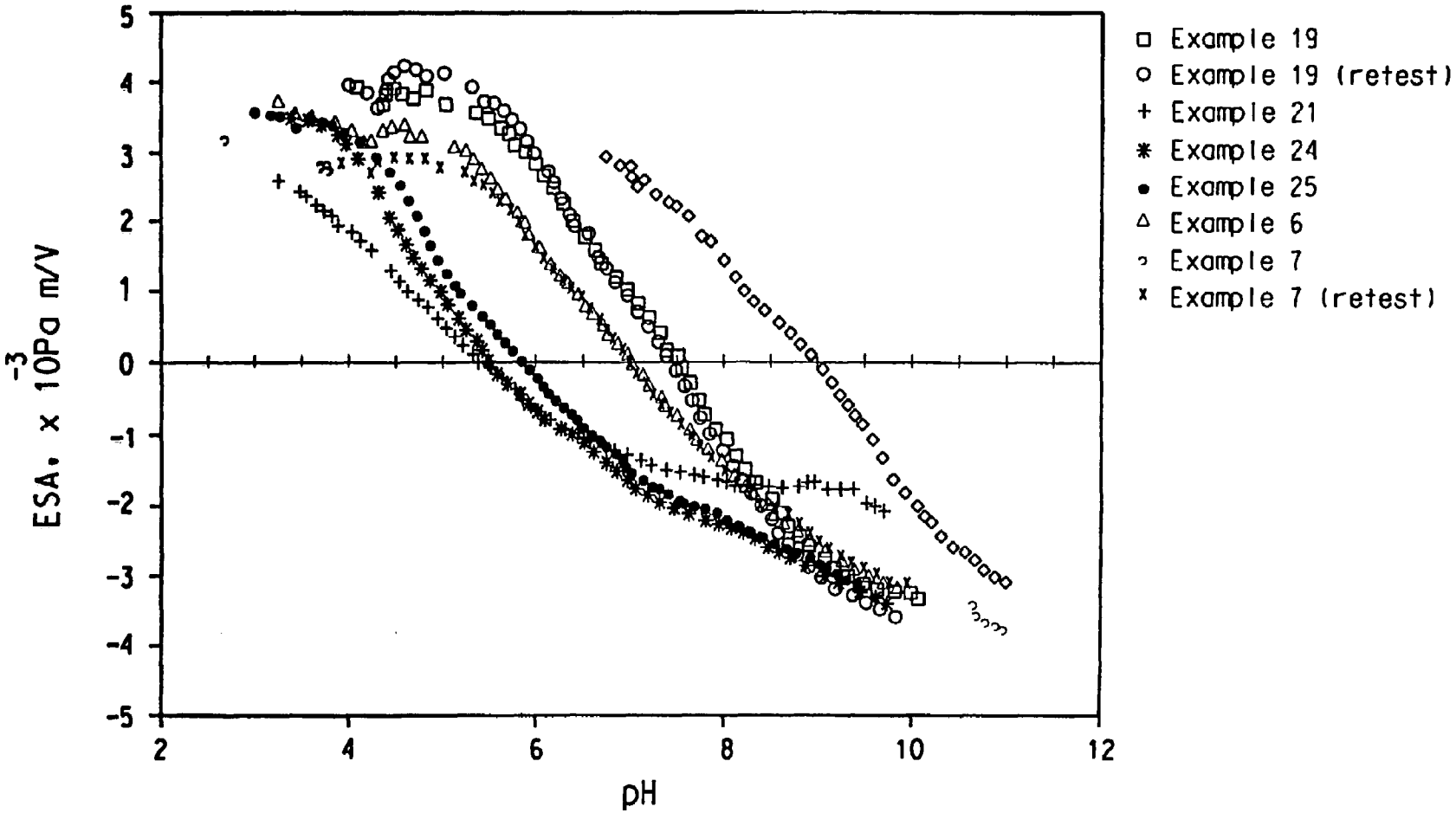
FIG. 5(*a*) shows supercritical milled $TiO_2$ in $KNO_3$ titrated against $HNO_3$ and KOH.

Dispersion of $TiO_2$ Powder in SC Mill $TiO_2$ was milled using the HPMM as described herein, and compared to standard $TiO_2$ (R900, available from E. I duPont de Nemours and Co., Wilmington, Del.). To that end, a number of particle characterization techniques were employed, as shown in Table 3 below. Isoelectric points were determined using a Matec MBS 8000(Matec Applied Sciences, Mass.). The isoelectric point is the pH at which the ESA=0, a point coincident with zero zeta potential. The isoelectric point is determined by the instrument measuring the electrokinetic sonic amplitude (ESA) while titrating the dispersion in a stirred vessel against nitric acid (to lower the pH) or potassium hydroxide (to raise the pH) as shown in FIG. 5*a*. The dispersions of the SC products were prepared by mixing in a $10^{-3}$ mol/dm$^3$ solution of potassium nitrate and then dispersing in an ultrasonic bath for 30 seconds. The isoelectric points of the supercritical milling products were not the same as that of the starting material which is indicative of some difference in the surface chemistry.

There was no discernable difference in the particle size or surface properties between the starting material and the products after supercritical milling.

Figure 5B:
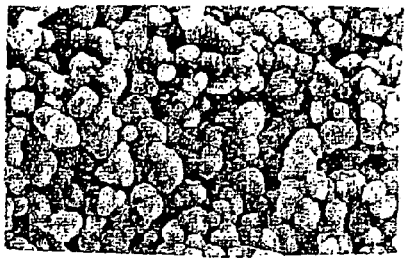
Figure 5C:
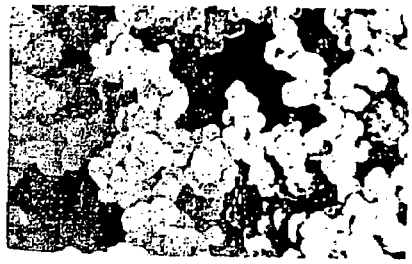

The bulk density of the SC milled product was twice as high as the starting material. The flowability improved. Additionally, the materials appeared the same based on the SEM's shown in FIGS. 5*b* and 5*c*.

Power intake and heating/cooling of the HPMM are interactive to keep the system at the desired/selected temperature. Monitoring of temperature is essential as small changes lead to a large pressure built-up. Monitoring of temperature and pressure allows the location of the SC point in the phase diagram.

After initial testing it was concluded that dispersion occurs fast with $TiO_2$ in the SC mill. The polymer bead collisions were sufficient to break down the $TiO_2$ agglomerates. The primary particle size was achieved within 10 minutes of grinding. Loading of mill was reasonably accurate with scale. Operation conditions followed a phase diagram. There was good circulation of mill contents, though heat exchange and mixing was poor at lower mill speeds. A mill charge of 50 to 70 volume percent of grinding bead gave good grinding results. The use of polymer beads reduced wear rate, compared to the use of ceramic beads (SEPR).

TABLE 3

| Example Number | | Appearance | SEM | Isoelectric point | pycnometric density | pore volume distribution by N2 | BET surface area, m2/g | d10, d50, d90, um | XRD, all TiO2. Crystal Size |
|---|---|---|---|---|---|---|---|---|---|
| 20 | starting material | clumpy white powder | done | 7.5 | 4.22 +/− 0.01 | no micro-porosity | 6.2 | 0.32, 0.60, 1.12 | 2337 |
| 21 | Starting material | fine grey powder | done | not enough | 3.875 +/− 0.005 | no micro-porosity | 40.2 | 0.20, 0.34, 0.88 | 610 |
| 22 | Starting material | fine grey powder | done | 5.5 | 4.086 +/− 0.008 | no micro-porosity | 8.9 | 0.16, 0.27, 0.45 | 899 |
| 23 | grinding media | grey beads | done | n/a | n/a | n/a | n/a | n/a | n/a |
| 24 | grinding media | fine grey powder | done | not enough | 4.130 +/− 0.006 | no micro-porosity | 8.2 | 0.17, 0.32, 0.64 | 1636 |
| 25 | grinding media | fine grey powder | done | 5.6 | 4.155 +/− 0.006 | no micro-porosity | 8.1 | 0.16, 0.27, 0.48 | 1603 |
| 26 | grinding media | fine grey powder | done | 5.9 | 4.176 +/− 0.004 | no micro-porosity | 8.3 | 0.16, 0.28, 0.44 | 1573 |
| Comp. B | R900 standard TiO2 | | | 9.0 | | | | | |

Electrokinetic Results:

Isoelectric points were determined using the Matec MBS 8000, as described above. The isoelectric point is the pH at which the ESA=0. The isoelectric points of the supercritical milling products were not the same as that of the starting material which is indicative of some difference in the surface chemistry.

There was no discernable difference in the particle size or surface properties between the starting material and the products after supercritical milling. The bulk density of the SC milled product was twice as high as the starting material. The flowability improved over the starting material.

Examples 27–31

Dispersion of Precipitated Silver Particles

Silver was milled using the high pressure media mill as described above. The product was characterized using scanning electron microscopy and also evaluated for particle size distribution, shape, isoelectric point and wettability.

TABLE 4

| Example Number | All the trials below were dry silver powders | PSD by Microtrac, d10, d50, d90, um | Scanning electron microscopy, dry mounted | Surface tension of EtOH/ Water mixtures needed to wet powder |
|---|---|---|---|---|
| 27 | | 1.15, 3.09, 6.21 | agglomerated with spherical primary particles appearing as about 0.5 to 1 um | >72.6 dyne/cm |
| 28 | | 0.81, 1.80, 106.8, bimodal with main peak at 2, another at 100 um | less regularly agglomerated, with irregular primary particles around 0.5 to 1 um. Plates or crust visible too. | <43.7 dynes/cm |
| 29 | | 0.20, 0.33, 0.59 | crusty appearance, spherical primary particles agglomerated and around 0.3 um and less. | n/a |
| 30 | | 0.62, 1.78, 9.21, normal with 2 big shoulders | irregular somewhat agglomerated primary particles of around 0.7 um and less. | <33.6 dynes/cm |
| 31 | | 1.17, 28.31, 260.1, main peak around 2 then many others at larger sizes | agglomerated irregular particles with some crust. Particle size 1 um and less. | <33.6 dynes/cm |

Only the "as received" sample wetted into water and so isoelectric points were not evaluated. Stearic acid coating seems to be expressed in the larger size of Examples 30 and 31 over Examples 28 and 29.

Pursuing the wetting aspect of the silver powder further revealed the following. Different ethanol/water ratios yield solutions having different surface tensions. These, in turn, will either wet, or not wet the powders. The silver Example 27 starting material is readily wetted by all solutions even as high as 72.6 dynes/cm, as was the Comparative C material. This is shown in Table 5.

TABLE 5

| % EtOH | Corrected % EtOH | Ex. 27 | Ex. 28 | Ex. 29 | Ex 30 | Ex. 31 | Comp. C | Measured surface, tension, dyne/cm |
|---|---|---|---|---|---|---|---|---|
| 100 | 70 | 0 | 0 | | 2, f | 2, f | 0 | 26.7 |
| 50 | 35 | 0 | 0 | | 1, f | 1, f | 0 | 29.1 |
| 75 | 52.5 | 0 | 0 | no sample | 0, f | 0, f | 0 | 33.6 |
| 25 | 17.5 | 0 | 2, f | | 99, nw | 99, nw | 0 | 43.7 |
| 10 | 7 | 1 | 99, f, nw | | 99, f, nw | 99, f, nw | 0 | 54.2 |
| 0 | 0 | 0 | 99, f, nw | | 99, f, nw | 99, f, nw | 0 | 72.6 |

number = wet in time, S (99 = didn't wet in)
nw = sediment was not wetted
f = not wetted silver on surface formed film The product shown in Example 28, which had no additives but had been treated in the supercritical mill, showed definite hydrophobic character. A surface tension less than 43.7 dynes/cm was needed to wet the powder. Immersional wetting was rather facile, probably due to exceptional density of the powder, but the most noticeable challenge was to internally wet the powder agglomerate when immersed.

The silvers which had been coated with stearic acid were even less wettable requiring surface tensions of less than 33.6 dynes/cm to wet them. More resolution could be achieved by using additional EtOH/water mixtures.

Processing silver powder in the HPMM didn't change the particle size dramatically but the surface appeared modified to become more hydrophobic. Addition of stearic acid to the supercritical mill, then venting the $CO_2$ seemed to leave an effective coating of the surfactant on the particles which was more hydrophobic than those treated in the SC mill without stearic acid. This confirmed that the particles had, indeed, been coated in this process.

What is claimed is:

1. A process for milling, comprising the steps of:

(a) adding grinding media and material to be milled to a high pressure media mill;

(b) evacuating mill to produce a vacuum;

(c) adding a supercritical fluid or volatile gas to said mill;

(d) pressurizing and maintaining pressure in said mill;

(e) adding feed particles to the mill;

(f) operating the mill to produce product particles having a median particle size of about 5 microns or less; and (g) selectina and maintaining temperature in said mill.

2. The process of claim 1, comprising the additional step of adding liquid or solid materials to coat said product particles.

3. The process of claim 1 or 2, wherein said process is continuous.

4. The process of claim 1 or 2 wherein the fluid is selected from the group consisting of $CO_2$, hydrofluorocarbons, propane, methane and combinations thereof.

5. The process of claim 1 or 2 wherein the grinding media is ceramic, glass, steel or polymeric material.

6. The process of claim 1 or 2 wherein 95% of the product particles are no larger than 1 μm in size.

7. The process of claim 4, wherein the $CO_2$ is in a liquid state.

8. The process of claim 1 or 2 wherein the median product particle size is about 2 micrometers or less.

9. The process of claim 1 wherein the median product particle size is 370 nanometers or less.

10. The process of claim 1 wherein the pressure is maintained at from about 600 psi to about 1800 psi.

11. The process of claim 1 wherein the temperature is maintained in the range between about 10° C. and about 45° C.

* * * * *